US007874859B2

(12) United States Patent
Suzuki

(10) Patent No.: US 7,874,859 B2
(45) Date of Patent: Jan. 25, 2011

(54) ELECTRIC CONNECTION BOX

(75) Inventor: Kaoru Suzuki, Kosai (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 11/641,723

(22) Filed: Dec. 20, 2006

(65) Prior Publication Data

US 2007/0148993 A1 Jun. 28, 2007

(30) Foreign Application Priority Data

Dec. 28, 2005 (JP) ..... P2005-379055

(51) Int. Cl.
*H01R 13/62* (2006.01)

(52) U.S. Cl. ..... 439/264

(58) Field of Classification Search ..... 439/34, 439/264; 296/70, 72, 208
See application file for complete search history.

(56) References Cited

U.S. PATENT DOCUMENTS 5,685,595 A * 11/1997 Nishijima et al. ..... 296/70
5,952,729 A * 9/1999 Shiratori et al. ..... 307/9.1
6,621,688 B1 * 9/2003 Burdick ..... 361/627

FOREIGN PATENT DOCUMENTS

JP 10-194011 * 7/1998
JP 2005-184913 A 7/2005

* cited by examiner

*Primary Examiner*—Phuong K Dinh
(74) *Attorney, Agent, or Firm*—Sughrue Mion, PLLC

(57) ABSTRACT

An electric connection box which is electrically connected to electrical equipments of an automobile via wire harnesses is installed at a center cluster provided at a central portion of an instrument panel of the automobile. A plurality of switches for controlling the electrical equipments are provided at a front portion of a connection box body of the electric connection box. Operating portions of the switches are exposed to form part of a design surface (front surface) of the center cluster.

2 Claims, 5 Drawing Sheets

ELECTRIC CONNECTION BOX

BACKGROUND OF THE INVENTION

1. Field of the Invention

This invention relates to en electric connection box (i.e., an electric junction block), such as a relay box, a fuse box and an ECU (electronic control unit) box, having an intensive electric circuit-connecting function provided within a box.

2. Related Art

Generally, an electric connection box is installed at an instrument panel within a passenger compartment of an automobile. However, a place where the electric connection box is installed at the instrument panel is usually considerably limited from the viewpoint of a vehicle design.

More specifically, the electric connection box does not belong to design parts, forming at least part of the interior decoration within the passenger compartment, and electric operating parts such as a switch, and therefore basically there is no vehicle design concept in which the electric connection box is allowed to be installed or mounted at those portions (e.g. a front portion or an upper portion) of the instrument panel which are important for the aesthetic appearance of the instrument panel and also for the operation of the electrical equipments.

Therefore, under the actual circumstances, the electric connection box must be mounted at an end portion (such as a lower end portion) of the instrument panel. On the other hand, in order to provide a comfortable compartment space, the on-board parts are always required to have a compact design so as to increase the compartment space.

Therefore, the electric connection box, incorporating branching/connecting circuits for wire harnesses for connection to electric parts (electrical equipments) provided at the instrument panel, function circuits, etc., is disposed at such a position (more specifically, at an end portion (such as a lower end portion) of the instrument panel as described above) that the wire harnesses must be laid out or installed long. Therefore, an improvement need to be made so that the electric connection box can be disposed at such a position that the wire harnesses can be laid out as short as possible. If the wire harnesses are thus laid out short, this can greatly contribute to the compact design, the reduction of the costs and the reduction of a DC resistance of a conductor of each wire harness.

Electrical connection between the wire harness and the electric connection box is made by fitting a plurality of connectors of the wire harness respectively to a plurality of connector portions provided at the electric connection box. Therefore, the number of connector-fitting operations is large, and therefore it is also necessary to improve the efficiency of the operation so as to reduce the cost (that is, a labor cost).

Incidentally, there is known an electric connection box-installation structure in which an electric connection box is provided at a rear surface of a meter mounted on a steering column (see JP-A-2005-184913 Publication). This installation structure is advantageous in that the electric connection box is positively disposed at the rear surface of the meter which is a main electric part of an automobile and that electrical connection between the electric connection box and the meter is made by connectors without using any wire harness.

However, in view of the above circumstances, it is more desirable that the electric connection box can be electrically connected to more electrical equipments.

SUMMARY OF THE INVENTION

This invention has been made in view of the above circumstances, and an object of the invention is to provide an electric connection box-installation structure and an electric connection box, in which a wire harness can be laid out as short as possible.

The above object has been achieved by an electric connection box-installation structure having features recited in the following Paragraphs (1) and (2).

(1) An electric connection box-installation structure characterized in that an electric connection box which is electrically connected to an electrical equipment of an automobile via a wire harness is installed at a center cluster provided at a central portion of an instrument panel of the automobile.

(2) The electric connection box-installation structure of the above Paragraph (1) is further characterized in that the electric connection box includes a switch for controlling the electrical equipment, and an operating portion of the switch is exposed to form part of a design surface of the center cluster.

In the installation structure of the construction of the above Paragraph (1), the electric connection box which is electrically connected to the electrical equipment of the automobile via the wire harness is installed at the center cluster provided at the central portion of the instrument panel of the automobile, and therefore the disposition of the electric connection box is effective particularly in laying out the wire harness (which connects the electrical equipment within the instrument panel to the electric connection box) short. And besides, since the electric connection box is disposed at the central portion of the instrument panel, wire harnesses can be installed to extend the shortest and equal lengths from the electric connection box, for example, respectively to two (left and right) electrical equipments of the same type, located respectively at left and right positions disposed line-symmetrically within the automobile, so as to electrically connect the electric connection box to the two electrical equipments. With this arrangement, DC resistances of conductors of the wire harnesses are made equal to each other, and this is very suitable for those electrical equipments which do not like a situation in which a potential difference develops due to the slight difference between the DC resistances of the conductors. Furthermore, the wire harnesses can be arranged to have the shortest and equal lengths, respectively, and therefore not only a material cost of the wire harnesses but also the kinds of the wire harnesses can be reduced, and therefore this is desirable from the viewpoint of the reduction of the costs.

In the installation structure of the construction of the above Paragraph (2), the electric connection box includes the switch for controlling the electrical equipment, and the operating portion of the switch is exposed to form part of the design surface of the center cluster, and therefore the electric connection box can be suitably integrated with the center cluster which is important for the aesthetic appearance of the instrument panel and also for the operation of the electrical equipment. Therefore, a compact design of the instrument panel as a whole can be achieved.

Further, the above object has been achieved by an electric connection box having features recited in the following Paragraphs (3) and (4).

(3) An electric connection box characterized in that the electric connection box is installed at a center cluster provided at a central portion of an instrument panel of an automobile, and is electrically connected to an electrical equipment of the automobile via a wire harness; and the electric connection box has a surface which forms part of a design surface of the center cluster.

(4) The electric connection box of the above Paragraph (3) is further characterized in that the electric connection box further includes a switch for controlling the electrical equipment; and an operating portion of the switch is exposed at the surface forming part of the design surface of the center cluster.

The electric connection box of the construction of the above Paragraph (3) is installed at the center cluster provided at the central portion of the instrument panel, and is electrically connected to the electrical equipment of the automobile via the wire harness. Therefore, the electric connection box is disposed at such a portion of the instrument panel that particularly the wire harness for connecting the electrical equipment within the instrument panel to the electric connection box can be effectively laid out short. And besides, since the electric connection box is disposed at the central portion of the instrument panel, wire harnesses can be installed to extend the shortest and equal lengths from the electric connection box, for example, respectively to two (left and right) electrical equipments of the same type, located respectively at left and right positions disposed line-symmetrically within the automobile, so as to electrically connect the electric connection box to the two electrical equipments. With this arrangement, DC resistances of conductors of the wire harnesses are made equal to each other, and this is very suitable for those electrical equipments which do not like a situation in which a potential difference develops due to the slight difference between the DC resistances of the conductors. Furthermore, the wire harnesses can be arranged to have the shortest and equal lengths, respectively, and therefore not only the material cost of the wire harnesses but also the kinds of the wire harnesses can be reduced, and therefore this is desirable from the viewpoint of the reduction of the costs. Furthermore, the electric connection box of the construction of the above Paragraph (3) has the surface forming part of the design surface of the center cluster, and therefore the electric connection box can be suitably integrated with the center cluster which is important for the aesthetic appearance of the instrument panel and also for the operation of the electrical equipments. Therefore, a compact design of the instrument panel as a whole can be achieved.

The electric connection box of the construction of the above Paragraph (4) further includes the switch for controlling the electrical equipment, and the operating portion of the switch is exposed at the surface forming part of the design surface of the center cluster. Therefore, the electric connection box can be more suitably integrated with the center cluster which is important for the aesthetic appearance of the instrument panel and also for the operation of the electrical equipments. Therefore, the compacter design of the instrument panel as a whole can be achieved.

In the present invention, there can be provided the electric connection box-installation structure and the electric connection box, in which the wire harness can be laid out as short as possible.

The present invention has been briefly described above. Details of the invention will become more manifest upon reading the following Section "DETAILED DESCRIPTION OF THE PREFERRED EMBODIMENTS" with reference to the accompanying drawings.

DETAILED DESCRIPTION OF THE PREFERRED EMBODIMENTS

A preferred embodiment of the present invention will now be described in detail with reference to FIGS. 1 to 5.

Figure 1:
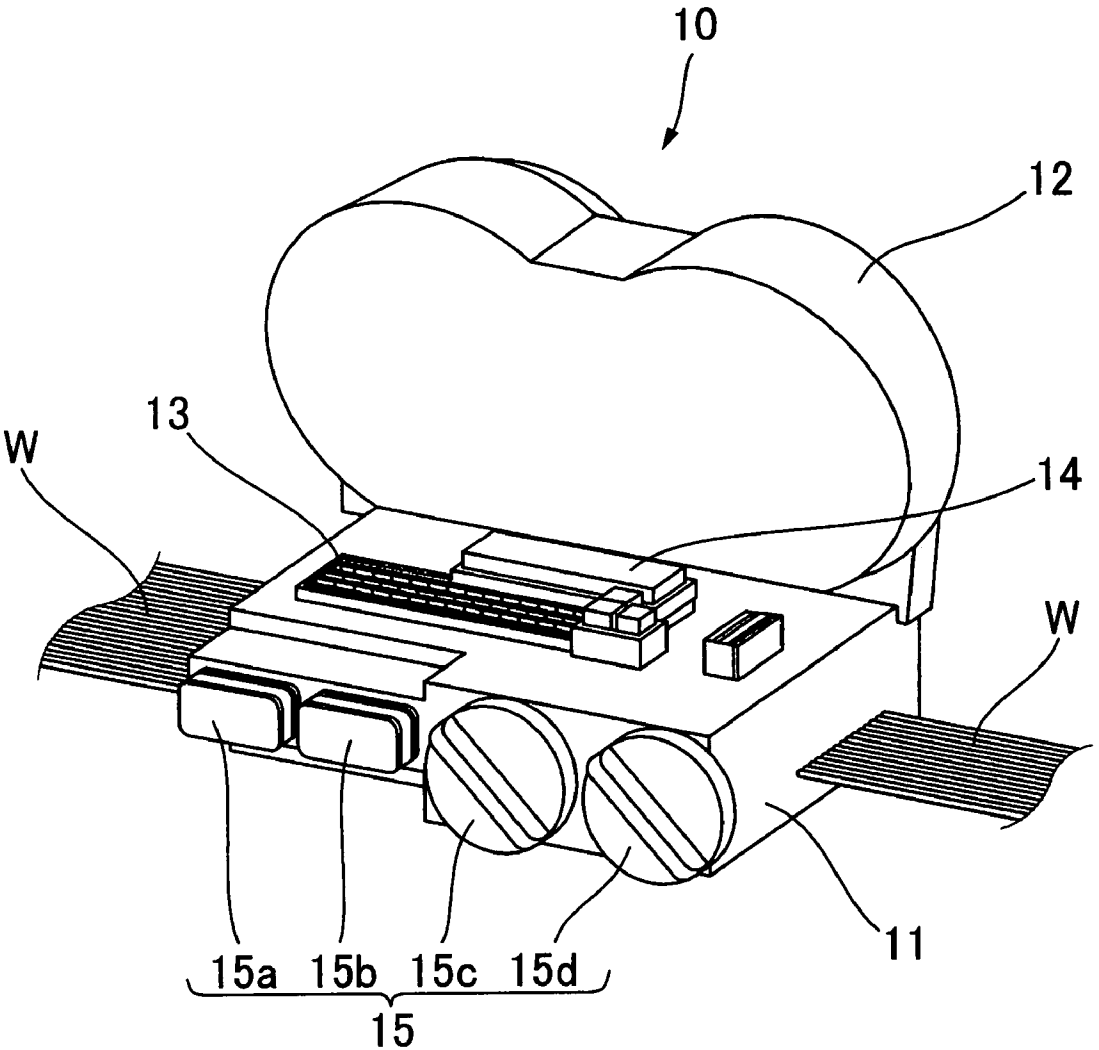
FIG. 1 is a perspective view of a preferred embodiment of an electric connection box of the present invention, mainly showing its front surface, one side surface and upper surface.
Figure 2:
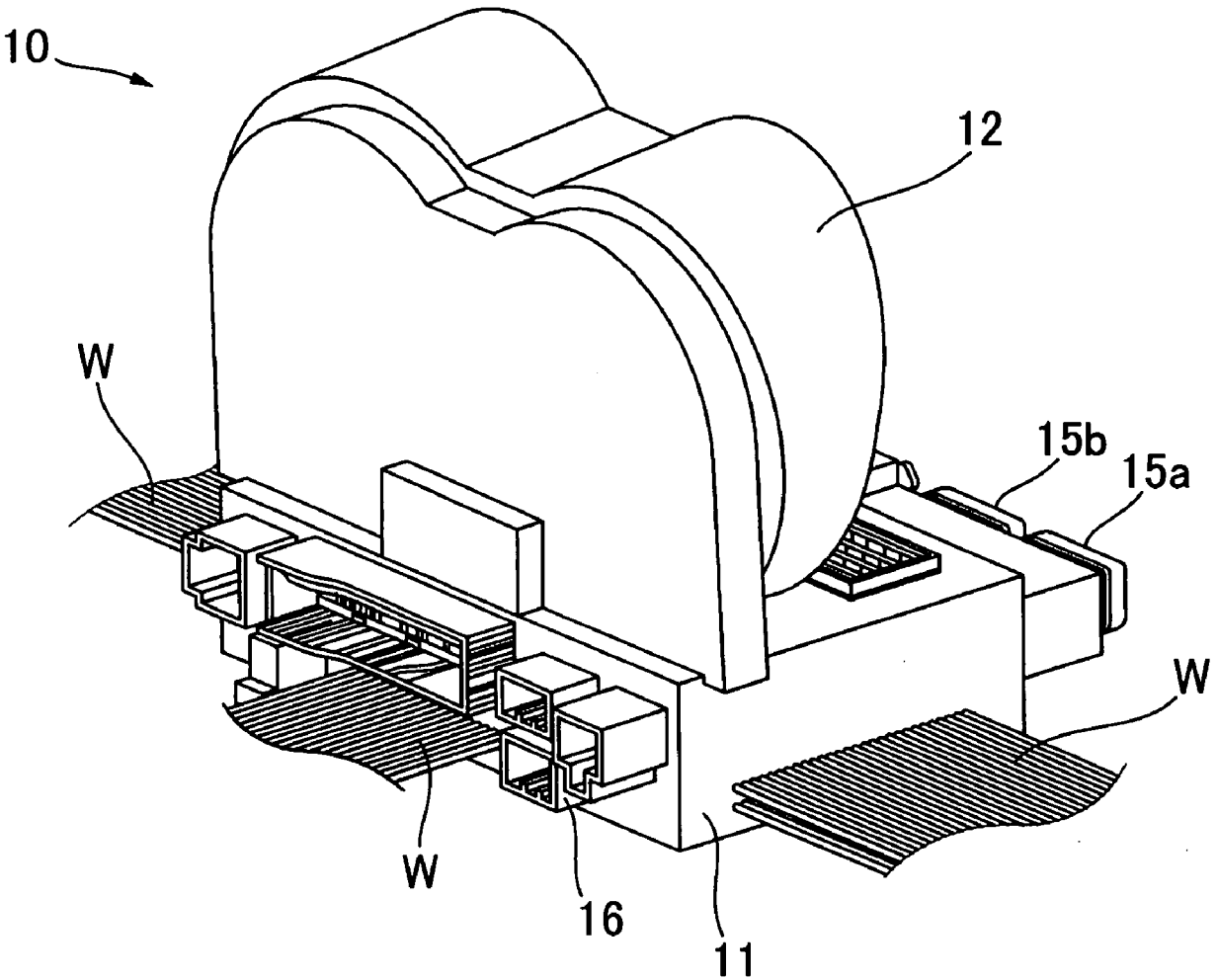
FIG. 2 is a perspective view of the electric connection box of FIG. 1, mainly showing its rear surface, other side surface and upper surface.
Figure 3:
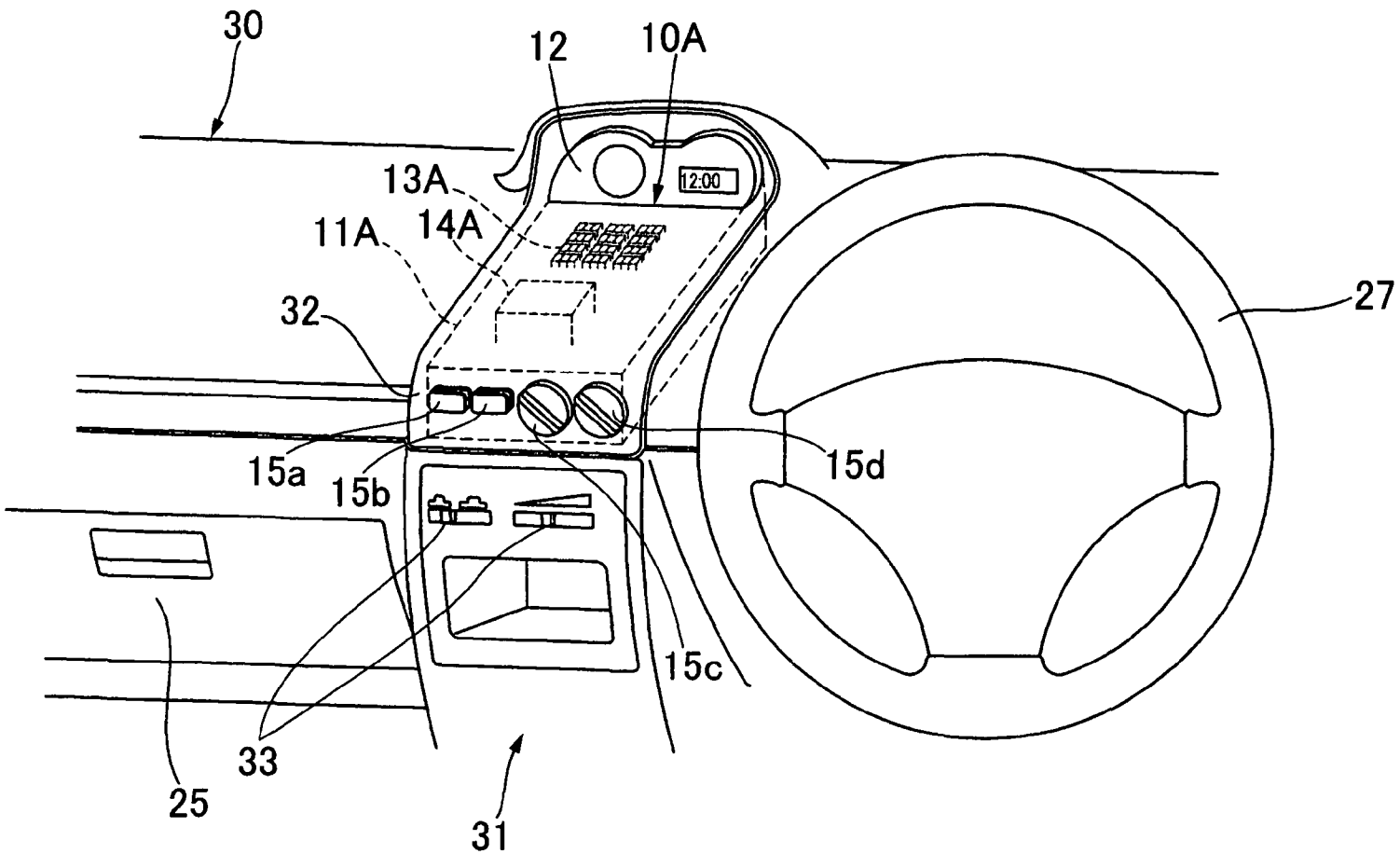
FIG. 3 is a perspective view of an installation structure in which the electric connection box of FIGS. 1 and 2 is suitably modified, and is installed at an instrument panel within a passenger compartment of an automobile.
Figure 4:
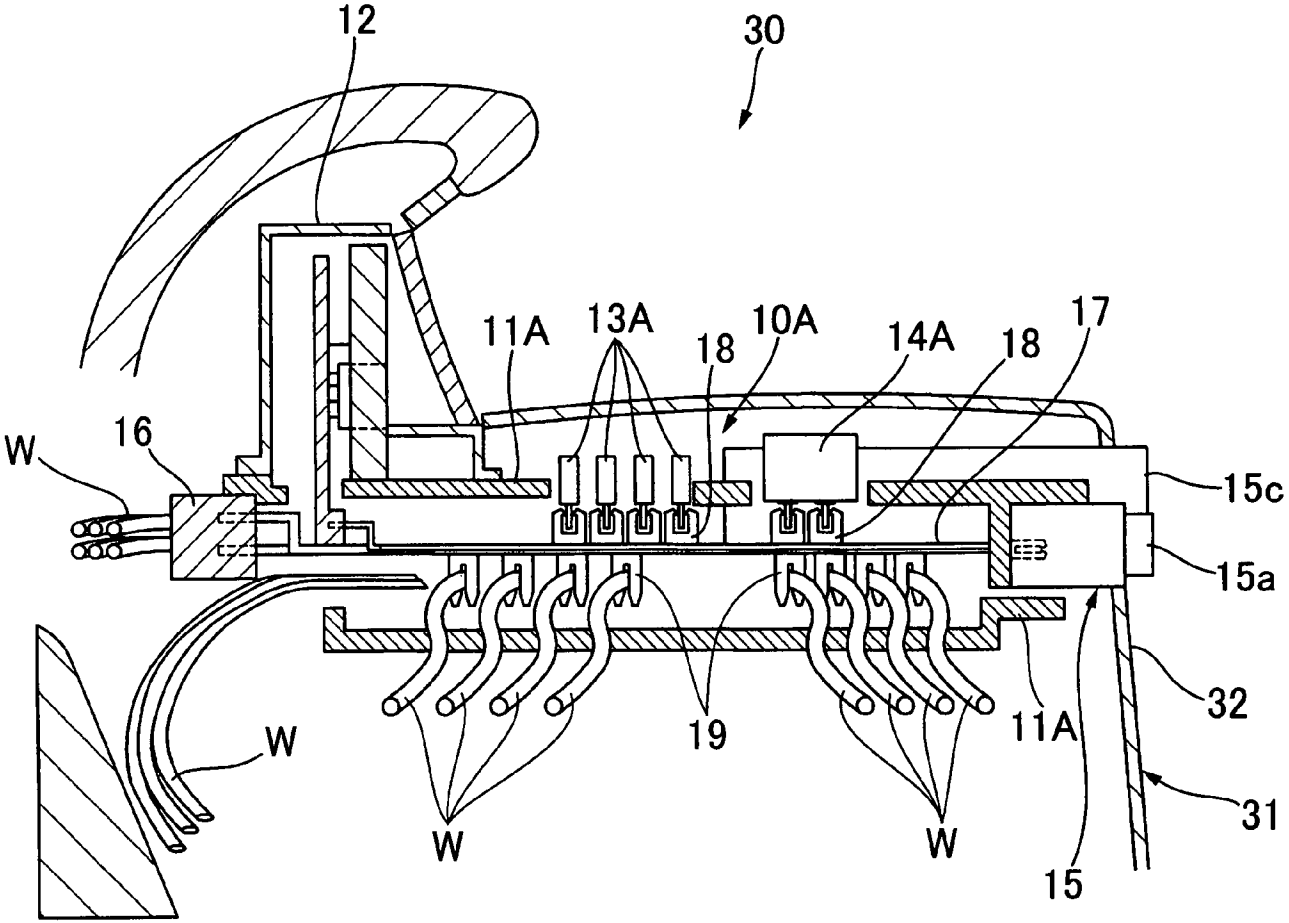
FIG. 4 is a vertical cross-sectional view of an important portion of the installation structure of FIG. 3.
Figure 5:
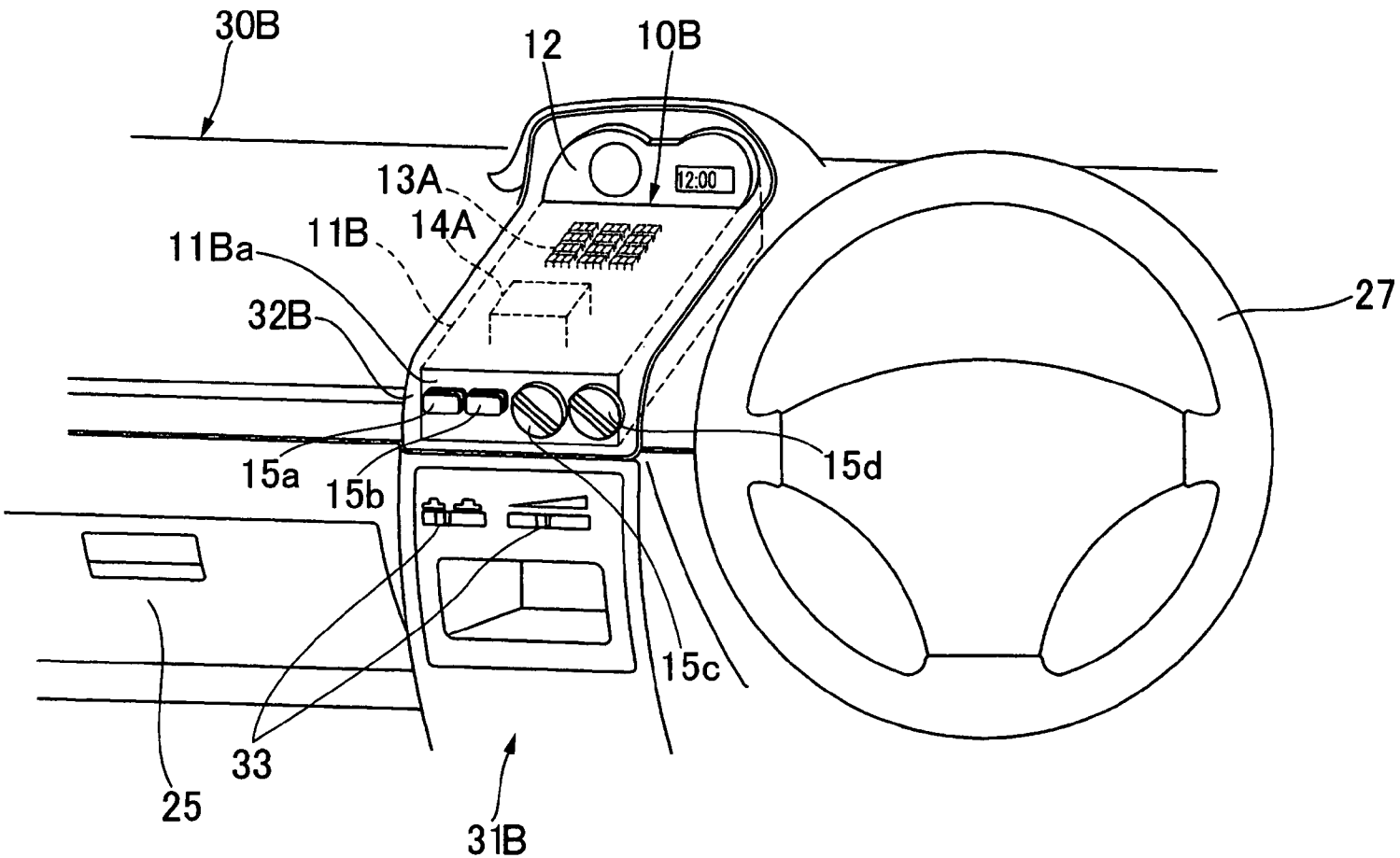
FIG. 5 is a perspective view of a further modified example of the electric connection box installed at the instrument panel shown in FIGS. 3 and 4.

FIG. 1 is a perspective view of one preferred embodiment of an electric connection box of the invention, mainly showing its front surface, one side surface and upper surface, FIG. 2 is a perspective view of the electric connection box of FIG. 1, mainly showing its rear surface, other side surface and upper surface, FIG. 3 is a perspective view of an installation structure in which the electric connection box of FIGS. 1 and 2 is suitably modified, and is installed at an instrument panel within a passenger compartment of an automobile, FIG. 4 is a vertical cross-sectional view of an important portion of the installation structure of FIG. 3, FIG. 5 is a perspective view of a further modified example of the electric connection box installed at the instrument panel shown in FIGS. 3 and 4.

As shown in FIGS. 1 and 2, the electric connection box 10 comprises a connection box body 11, and a meter 12 which is mounted on an upper portion of a rear surface of the connection box body 11, and is electrically connected to electric circuits within the connection box body 11. The connection box body 11 has electric parts including a plurality of blade-type fuses 13 and a relay array 14 formed by combining a plurality of relays together in an integrated manner, and these electric parts are electrically connected to the electric circuits within the connection box body 11. The electric parts (the blade-type fuses 13, the relay array 14, etc.) are arranged to project from the upper surface of the connection box body 11. The electric circuits within the connection box body 11 are electrically connected to conductors of wires of wire harnesses W.

Four switches 15 for controlling electrical equipments of the automobile are provided at a front portion of the connection box body 11. These switches 15 have respective portions projecting from the front surface of the connection box body 11. More specifically, the operating portion 15*a* of the push button switch for effecting an ON/OFF control of a defogger (defroster), the operating portion 15*b* of the push button switch for effecting an ON/OFF control of hazard lamps, the operating portion 15*c* of the rotary switch for effecting an ON/OFF control of wipers and for controlling the operating speed of the wipers, and the operating portion 15*d* of the rotary switch for effecting an ON/OFF control of headlamps and for controlling the brightness of the headlamps are exposed at the front surface of the connection box body 11. A plurality of connector portions 16 for electrical connection to other electric parts by connectors are formed at the rear surface of the connection box body 11.

FIGS. 3 and 4 show the installation structure in which the electric connection box 10 is suitably modified (For example, the outer size of the electric connection box 10 and the arrangement of the various parts within the electric connection box 10 are suitably changed), and is installed at the instrument panel within the passenger compartment of the automobile. In the installation structure of the modified electric connection box shown in FIGS. 3 and 4, those parts and portions similar in construction and operation to those already described with reference to FIGS. 1 and 2 will be designated by identical or like reference numerals, respectively, and explanation thereof will be omitted or simplified.

As shown in FIGS. 3 and 4, the electric connection box 10A is provided within a center cluster 31 disposed at a central portion of the instrument panel 30 of the automobile, and this electric connection box 10A is electrically connected to electrical equipments of the automobile via wire harnesses W. In this structure of installation of the electric connection box 10A, the disposition of the electric connection box 10A is effective particularly in laying out the wire harnesses W (see FIG. 4) (which connect the electrical equipments within the instrument panel 30 to the electric connection box 10A) short. And besides, the electric connection box 10A is disposed at the central portion of the instrument panel 30, and therefore the wire harnesses W can be installed to extend the shortest and equal lengths from the electric connection box 10A, for example, respectively to two (left and right) electrical equipments of the same type, located respectively at left and right positions disposed line-symmetrically within the automobile, so as to electrically connect the electric connection box 10A to the two electrical equipments. With this arrangement, DC resistances of conductors of the wire harnesses W are made equal to each other, and this is very suitable for those electrical equipments which do not like a situation in which a potential difference develops due to the slight difference between the DC resistances of the conductors. Furthermore, the wire harnesses W can be arranged to have the shortest and equal lengths, respectively, and therefore not only the material cost of the wire harnesses W but also the kinds of the wire harnesses can be reduced, and therefore this is desirable from the viewpoint of the reduction of the costs.

Operating portions 15*a*, 15*b*, 15*c* and 15*d* of four switches 15 are exposed to form part of a design surface (front surface) 32 of the center cluster 31. In this structure of installation of the electric connection box 10A, the electric connection box 10A can be suitably integrated with the center cluster 31 which is important for the aesthetic appearance of the instrument panel 30 and also for the operation of the electrical equipments. Therefore, a compact design of the instrument panel 30 as a whole can be achieved.

In FIG. 3, reference numeral 33 denotes slide switches for controlling an air conditioner. In the center cluster 31, the slide switches 33 are disposed below the operating portions 15*a*, 15*b*, 15*c* and 15*d* of the four switches 15 of the electric connection box 10A. Reference numeral 25 denotes a glove compartment disposed adjacent to the left side of the center cluster 31. Reference numeral 27 denotes a steering wheel disposed adjacent to the right side of the center cluster 31.

A blade-type fuse array 13A formed by combining a plurality of blade-type fuses 13 together in an integrated manner, a relay array 14, etc., are arranged within a connection box body 11A of the electric connection box 10A, and are electrically connected to electric circuits within the connection box body 11A. As shown in FIG. 4, terminals of the blade-type fuse array 13A, relay array 14A, etc., are gripped by and connected to respective tuning fork-shaped terminals 18 formed in a upstanding manner on an upper surface of a electric circuit board 17 provided within the connection box body 11A. These tuning fork-shaped terminals 18 are electrically connected to electric circuits of the electric circuit board 17.

As shown in FIG. 4, a plurality of press-contacting terminals 19 are formed on and project downwardly from a lower surface of the electric circuit board 17 within the connection box body 11A, and are electrically connected to the electric circuits of the electric circuit board 17. The conductors of the wires of the wire harnesses W are collectively press-contacted with press-contacting blades of the press-contacting terminals 19, and are electrically connected thereto. This electric connection box 10A is electrically connected directly to the wire harnesses W by collective press-contacting connection which is different from the ordinary connector connection. Therefore, the number of the connectors containing terminals can be reduced, and besides the efficiency of the operation can be improved, and therefore the costs, that is, the material cost and the labor cost, can be reduced.

The present invention is not limited to the above embodiment and modified example, and suitable modifications, improvements, etc., can be made. Furthermore, the material, shape, dimensions, numerical value, form, number, disposition, etc., of each of the constituent elements of the above embodiment and modified example are arbitrary, and are not limited in so far as the invention can be achieved.

For example, the electric connection box of the invention can take such a form that its connection box body has a surface which forms part of the design surface of the center cluster. Such another modified electric connection box is shown in FIG. 5. In the modified electric connection box shown in FIG. 5, those parts and portions similar in construction and operation to those already described with reference to FIGS. 3 and 4 will be designated by identical or like reference numerals, respectively, and explanation thereof will be omitted or simplified.

As shown in FIG. 5, the electric connection box 10B is provided at a center cluster 31B disposed at a central portion of an instrument panel 30B of the automobile, and is electrically connected to electrical equipments of the automobile via wire harnesses W (see FIG. 4). A connection box body 11B of this electric connection box 10B has a front surface 11Ba forming part of a design surface (front surface) 32B of the center cluster 31B as described above. In other words, the design surface 32B of the center cluster 31B includes the front surface 11Ba of the connection box body 11B.

Thus, the electric connection box 10B is disposed at such a portion of the instrument panel 30B that particularly the wire harnesses W (see FIG. 4) for connecting the electrical equipments within the instrument panel 30B to the electric connection box 10B can be effectively laid out short. And besides, the electric connection box 10B is disposed at the central portion of the instrument panel 30B, and therefore the wire harnesses W can be installed to extend the shortest and equal lengths from the electric connection box 10B, for example, respectively to two (left and right) electrical equipments of the same type, located respectively at left and right positions disposed line-symmetrically within the automobile, so as to electrically connect the electric connection box 10B to the two electrical equipments. With this arrangement, DC resistances of conductors of the wire harnesses W are made equal to each other, and this is very suitable for those electrical equipments which do not like a situation in which a potential difference develops due to the slight difference between the DC resistances of the conductors. Furthermore, the wire harnesses W can be arranged to have the shortest and equal lengths, respectively, and therefore not only the material cost of the wire harnesses W but also the kinds of the wire harnesses can be reduced, and therefore this is desirable from the viewpoint of the reduction of the costs. Furthermore, the electric connection box 10B has the front surface 11Ba forming part of the design surface 32B of the center cluster 31B, and therefore the electric connection box 10B can be suitably integrated with the center cluster 31B which is important for the aesthetic appearance of the instrument panel 30B and also for the operation of the electrical equipments. Therefore, a compact design of the instrument panel 30B as a whole can be achieved.

The electric connection box 10B includes a plurality of switches 15, and operating portions 15*a*, 15*b*, 15*c* and 15*d* of these switches 15 are exposed at the front surface 11Ba of the connection box 11B, and therefore the electric connection box 10B can be more suitably integrated with the center cluster 31B which is important for the aesthetic appearance of the instrument panel 30B and also for the operation of the electrical equipments. Therefore, the compacter design of the instrument panel 30B as a whole can be achieved.

In the above embodiments and modified examples, the push button switch for effecting the ON/OFF control of the defogger (defroster), the push button switch for effecting the ON/OFF control of the hazard lamps, the rotary switch for effecting the ON/OFF control of the wipers and for controlling the operating speed of the wipers, and the rotary switch for effecting the ON/OFF control of the headlamps and for controlling the brightness of the headlamps are used as the plurality switches 15. However, these switches are given merely as examples, and switches of other kinds than those of the above-mentioned switches can be used. For example, instead of the two rotary switches, a rotary switch for effecting an ON/OFF control of an immobilizer and a rotary switch serving, for example, as an ignition switch can be used.

What is claimed is:

1. An electric connection box module configured to be installed at a center cluster provided at a central portion of an instrument panel of an automobile, said electric connection box module comprising:

a connection box body electrically connected to an electrical equipment of said automobile via a wire harness, a control part integrally formed with said connection box body, wherein said control part is provided with at least one switch for controlling said electrical equipment directly provided on a front part of said connection box body, and wherein said switch is exposed to form a part of said center cluster when said electric connection box module is installed, wherein the connection box body is an electric junction block forming a hub that is directly connected to plural terminals of the electrical equipment via separate wires of the wire harness, and wherein the electric junction block forming the hub is directly connected through an electric circuit board within the connection box body to the plural terminals of the electrical equipment via the separate wires of the wire harness.

2. An electric connection box module wherein said electric connection box module is installed at a center cluster provided at a central portion of an instrument panel of an automobile, and is electrically connected to an electrical equipment of said automobile via a wire harness, comprising:

a connection box body; and a meter which is mounted on an upper portion of a rear surface of said connection box body and is electrically connected to electric circuits of an electric circuit board within said connection box body, wherein said connection box body has a surface which forms part of a design surface of said center cluster, wherein said electric connection box module further includes at least one switch for controlling said electrical equipment; and an operating portion of said switch is exposed at said surface forming part of said design surface of said center cluster, wherein the connection box body is an electric junction block forming a hub that is directly connected through the electric circuit board to plural terminals of the electrical equipment via separate wires of the wire harness.

* * * * *